US006206061B1

(12) United States Patent
Koike

(10) Patent No.: US 6,206,061 B1
(45) Date of Patent: Mar. 27, 2001

(54) VENEER CUTTING MACHINE AND NOSE BAR DEVICE THEREFOR

(75) Inventor: Masaru Koike, Aichi (JP)

(73) Assignee: Meinan Machinery Works, Inc., Obu (JP)

( * ) Notice: Subject to any disclaimer, the term of this patent is extended or adjusted under 35 U.S.C. 154(b) by 0 days.

(21) Appl. No.: 09/460,541

(22) Filed: Dec. 14, 1999

(30) Foreign Application Priority Data

Dec. 15, 1998 (JP) ..... 10-375651
Jul. 12, 1999 (JP) ..... 11-197743

(51) Int. Cl.[7] ..... B27L 5/02
(52) U.S. Cl. ..... 144/213; 144/209.1; 144/365
(58) Field of Search ..... 144/209.1, 211, 144/212, 213, 365

(56) References Cited

U.S. PATENT DOCUMENTS 437,039 9/1890 Oncken .
4,061,169 * 12/1977 Hasegawa ..... 144/213
4,494,589 * 1/1985 Kajikawa et al. ..... 144/213
5,447,185 * 9/1995 Koike ..... 144/213
5,791,388 * 8/1998 Nakaya ..... 144/213

* cited by examiner

*Primary Examiner*—W. Donald Bray
(74) *Attorney, Agent, or Firm*—Morgan & Finnegan, L.L.P.

(57) ABSTRACT

A nose bar device for a veneer lathe which is equipped with a knife carriage movable toward and away from a log from which a veneer sheet is cut, and a knife mounted on the knife carriage and having at the tip end thereof a cutting edge extending horizontally across the direction in which the knife carriage is moved. The lathe further includes a plurality of nose bars juxtaposed along the cutting edge of the knife and mounted to a block which forms a part the knife carriage and is adapted to be movable independently of the knife carriage. Each nose bar has at the lower end thereof a pressure edge located adjacent to the cutting edge of the knife for pressing against the log periphery adjacent to the knife cutting edge. There is provided a mechanism for independently adjustably moving the pressure edge of at least one of the nose bars toward and away from the cutting edge of the knife.

25 Claims, 15 Drawing Sheets

VENEER CUTTING MACHINE AND NOSE BAR DEVICE THEREFOR

FIELD OF THE INVENTION

The present invention relates to a veneer cutting machine such as rotary veneer lathe and veneer slicer and, more specifically, to a nose bar device disposed in the veneer cutting machine for pressing against a log at a position adjacent to the cutting edge of a knife of the veneer cutting machine.

BACKGROUND OF THE INVENTION

For better understanding of the present invention, a typical conventional nose bar device as applied to a rotary veneer lathe will be described with reference to FIGS. 1 and 2. It is to be understood that in describing the drawings only those portions of the construction of the veneer lathe has been shown which enable those skilled in the art to readily understand the underlying principle and concept of the present invention.

The veneer lathe includes a veneer peeling knife 5 having at its tip end a cutting edge 5*a* and fixed in a well-known manner to a knife mounting block 3 which forms a part of and is movable with a knife carriage of the lathe. The lathe further includes a block 9 which also forms a part of the knife carriage and to which a number of nose bars 7 (only one being shown) are fixedly mounted by means of bolts 10 at a predetermined interval along the cutting edge 5*a* of the veneer knife 5. Each nose bar 7 includes an upper base portion 7*a*fixed to the nose bar mounting block 9 and a free end portion having at its lower end a pressure portion 8 In the form of an insert which is made of hard and wear resistant material and fitted to the tip end of the nose bar 7. Reference symbol 8*a* designates the front edge of the insert 8. The nose bar mounting block 9 is adjustably movable independently of the knife carriage in the double-headed arrow direction for positioning the front edge 8*a* of the pressure portion 8 with respect to the cutting edge 5*a* of the knife 5 so as to determine the distance therebetween in dependence on the thickness of wood veneer sheet to be peeled from a log by the knife 5.

It is noted, however, that the respective nose bars 7 are not necessarily identical in their dimensions or shape because of errors in accuracies of finished nose bars and their associated parts, as well as errors which occur in assembling or mounting these parts. In other words, the front edges 8*a* of the respective nose bars 7, when fixed to the nose bar mounting block 9, may not lie precisely on a straight line parallel to the cutting edge 5*a* of the veneer knife 5. When the mounting block 9 carrying the nose bars 7 is adjusted such that the front edge 5*a* of any one of the nose bars 7, which happens to be located closest to the cutting edge 5*a* of the knife 5, is brought just into contact with the cutting edge 5*a* as shown in FIG. 1, the front edges 8*a* of the other nose bars 7 may be then positioned clear of the knife cutting edge 5*a*, for example, as shown in FIG. 2. When the nose bar mounting block 9 is moved back for adjustment of the desired spaced distance between the nose bar front edges 8*a* and the knife cutting edge 5*a*, the distances between the knife edge 5*a* and the respective nose bar edges 8*a* may be varied from one nose bar 7 to another.

In practice of setting of nose bars 7, the nose bar mounting block 9 is adjusted and moved to a position where the spaced distance between the front edge 8*a* of the nose bar 7 and the cutting edge 5*a* of the knife 5 is slightly smaller than the desired thickness of veneer sheet to be peeled by the lathe, for example, about 90% of veneer sheet thickness, thus the nose bars 7 are disposed to press against the log for a distance corresponding to about 10% of the veneer sheet thickness. When the nose bar mounting block 9 is adjusted such that a nose bar 7 having a pressure portion 8 whose front edge 8*a* is located closest to the knife cutting edge 5*a* is set according to the above practice, the remaining nose bars 7 are spaced from the cutting edge 5*a* at a distance greater than 90% of the veneer thickness. In such a nose bar setting, the peeler log may be pressed insufficiently in the region thereof where the nose bars 7 are located too far from the knife cutting edge 5*a,* so that the resulting veneer sheet may be formed with relatively large and hence harmful checks or cracks and rough surfaces. Apparently, this will invite poor quality of veneer sheet.

On the other hand, if the nose bar mounting block 9 is adjusted such that a nose bar 7 having a pressure portion 8 whose front edge 8*a* is located farthest from the knife cutting edge 5*a* is set according to the above practice, nose bars 7 other than the above farthest one will be spaced from the cutting edge 5*a* by a distance less than 90% of the veneer sheet thickness. In such a case, the peeler log may be pressed excessively In the region thereof where the nose bars 7 are located too close to the knife cutting edge 5*a* with the result that the resulting veneer sheet may be formed partially thinner than desired, thus rendering the veneer sheet quality unacceptable. In a worse case when the space between the nose bar front edges 8*a* and the knife cutting edge 5*a* is too tight, a a veneer sheet just cut by the knife may fail to pass successfully through space and, therefore, be damaged or broken. As a result, veneer yield will be reduced remarkably and veneer quality seriously degraded.

Importantly, it is to be noted that such problems become noticeable, in particular, when producing a relatively thin veneer sheet. In peeling a sheet having a thickness of, for example, about 0.3 mm in the setting of about 0.27 mm of edge-to-edge distance corresponding to about 90% of veneer sheet thickness, the pressing amount which corresponds to 10% of the thickness, will be only about 0.03 mm. Apparently, the peeler log for such thin veneer sheet tends to be pressed either only very little or excessively depending on its locations. Thus, the prior art nose bar device has been unable to cope with the problems which occur in cutting a thin veneer sheet.

The problems may be solved to some extent by improving the machining accuracies of the knife mounting block 3, nose bar mounting block 9, nose bars 7 and their inserts 8, but only at the sacrifice of Increased of cost of the nose bar device and its related parts of the veneer lathe.

In a veneer lathe of the type which has a pair of spindles between which a peeler log is supported and driven, the log may hit part of the nose bars 7 while it is being loaded between the spindles. In such a case, the hit nose bars 7 may be deformed such that their lower free end portions are bent away from the knife cutting edge 5*a*. Such deformed nose bars 7 will cause the problems as referred to above.

SUMMARY OF THE INVENTION

Therefore, it is an object of the invention to provide a nose bar device which can solve the above problems and also a veneer cutting machine, in particular, a rotary veneer lathe which is equipped with such a nose bar device. According to the invention, a rotary veneer lathe has a knife carriage which is movable toward and away from a block or a peeler log from which a veneer sheet is peeled, and a knife mounted on the knife carriage and having at the tip end thereof a cutting edge extending horizontally across the direction in which the knife carriage is moved. The lathe further comprises a plurality of nose bars juxtaposed along the cutting edge of the knife and mounted to a block which forms a part of the knife carriage and adapted to be movable independently of the knife carriage. Each nose bar has at the lower end thereof a pressure edge located adjacent to the cutting edge of the knife and a width extending in parallel to the cutting edge of the knife for pressing against the log adjacent to that cutting edge. There is provided a mechanism for independently adjustably moving the pressure edge of at least one of the nose bars toward and away from the cutting edge of the knife, although the adjusting mechanism should provided preferably for each of the nose bars of the veneer lathe. Therefore, the following description on the summary of the invention will be made on the assumption that each nose bar has its own adjusting mechanism.

In a preferred embodiment constructed according to the invention, the nose bar has a fastener for fixing the one nose bar to the nose bar mounting part of the knife carriage at a position adjacent to the upper end of the nose bar, and the adjusting mechanism includes means for adjustably moving the pressure edge of the nose bar toward and away from the cutting edge of the knife by causing the nose bar to be deformed for displacement relative to the nose bar mounting part.

In the preferred embodiment of the invention, the moving means includes a screw disposed in a threaded hole which is formed through the nose bar in the direction in which the knife carriage is moved at a position below the fastener where the screw is contactable with the surface of the nose bar mounting part on the side adjacent to the nose bar. When turned in the appropriate direction, the adjusting screw is operable to cause the nose bar to be deformed for displacement relative to the nose bar mounting part by pressing against the above surface of the nose bar mounting part.

Preferably, the fastener for fixing the nose bar to the nose bar mounting part should take the form of a socket head screw having, for example, a hexagon socket, which is inserted through a hole formed through the nose bar at the above position adjacent to the upper end of the nose bar, so that its head lies within the hole, but an access thereto by an appropriate wrench for adjustment is possible. Likewise, the adjusting screw should preferably be in the form of a socket head set screw whose head is disposed within the threaded hole.

According to another embodiment of the invention, the above moving means may include a screw, preferably in the form of a socket head set screw, disposed in a threaded hole which is formed in the nose bar mounting part in the direction in which the knife carriage is moved at a position below the fastener where the screw is contactable with the surface of the nose bar adjacent to the nose bar mounting part. The screw is operable to cause the nose bar to be deformed for displacement relative to the nose bar mounting part by pressing against the surface of the one nose bar. For an access to the socket head of the screw in the nose bar mounting part, the nose bar has formed therethrough a hole extending substantially in axial alignment with the threaded hole in the nose bar mounting part and having an inner diameter smaller than the outer diameter of the screw.

As a modification of the above embodiment, the nose bar mounting part may be formed with a cut so as to provide an open space in the region adjacent to the position where the screw is contactable with the surface of the nose bar and the screw may include a bolt having a hexagon head and is disposed in the threaded hole with its head contactable with the surface in the open space.

In still another embodiment constructed according to the invention, there is provided a screw inserted through a hole which is formed through the nose bar in the direction in which the knife carriage is moved and also into a threaded hole which is formed in the nose bar mounting part for fastening the nose bar to the nose bar mounting part. In this case, the adjusting mechanism includes the above screw and the nose bar and its mounting part which are constructed so as to form a space therebetween such that the nose bar is supported in contact with the nose bar mounting part at two vertically spaced positions when the nose bar is fastened in place to the nose bar mounting part. The screw is inserted through and into the hole and the threaded hole, respectively, at a position intermediate between the two positions. Being turned in the appropriate direction, the screw is operable to cause the nose bar to be deformed in such a way as to reduce the volume of the space for displacement of the pressure edge relative to the nose bar mounting part by forcing against said the nose bar.

According to the invention, the nose bar may be divided at the portion thereof adjacent to the knife into at least two bar portions each having at the lower end thereof a pressure edge for pressing against a log adjacent to the cutting edge of said knife.

It is noted that the present invention is applicable to a rotary veneer lathe of the type which is equipped with a peripheral drive system which includes a drive shaft extending across said veneer lathe, a series of toothed drive wheels mounted on the drive shaft at a spaced interval and each having on the periphery thereof a number of pointed tooth-like projections which are engageable with log periphery for driving the log. The above nose bar divided at the bar portion thereof adjacent to the knife may be advantageously used in combination with such veneer lathe with peripheral drive system.

It is also noted the nose bar device according to the present invention may be used in a veneer cutting machine other than rotary veneer lathe.

The above and other objects, features and advantages of the invention will become apparent to those skilled in the art from the following description of embodiments of the veneer cutting machine according to the present invention, which description is made with reference to the accompanying drawings, wherein:

DETAILED DESCRIPTION OF PREFERRED EMBODIMENTS

Reference is made to the accompanying drawings. specifically to FIGS. 3 to 7 showing a preferred embodiment of a nose bar device constructed according to the invention and applied to a rotary veneer lathe.

Figure 1:
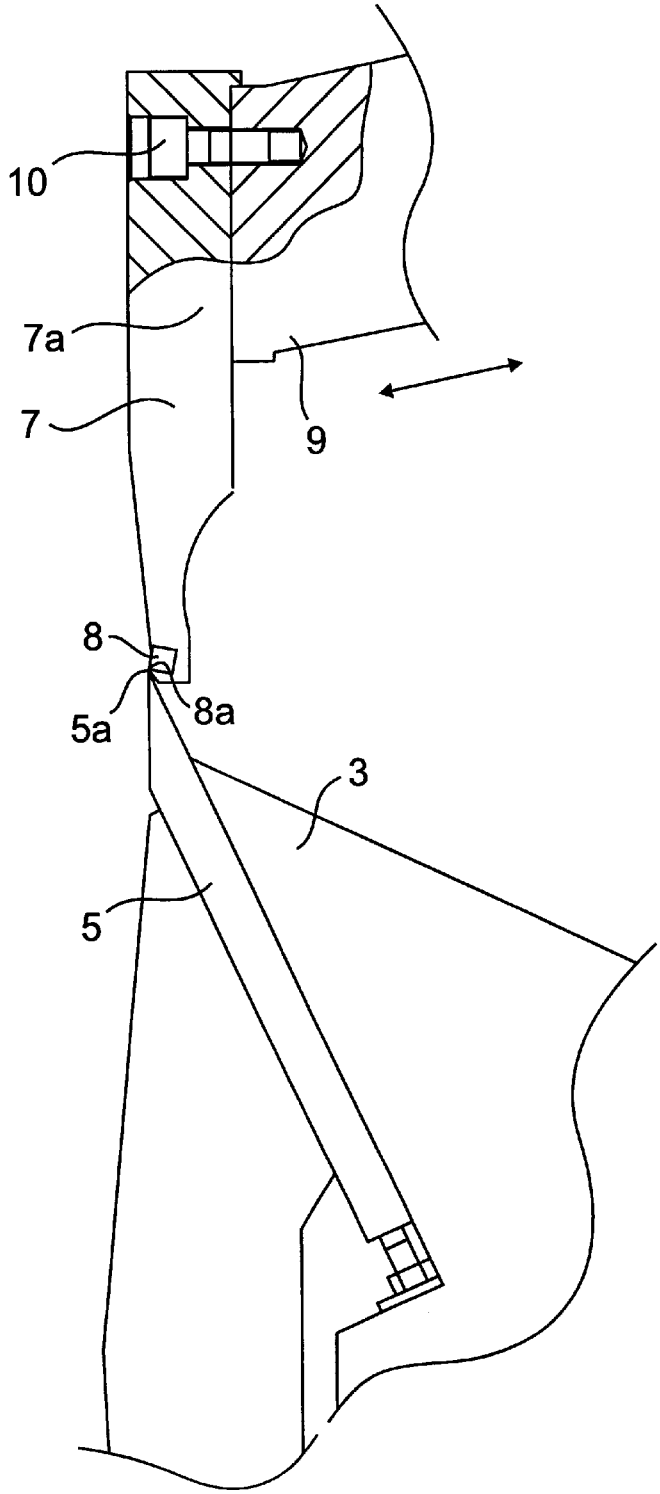
Fig. 1 (Prior Art)
FIG. 1 is a partially sectional fragmentary side view showing a prior art nose bar device disposed with respect to a veneer peeling knife in a rotary veneer lathe.
Figure 2:
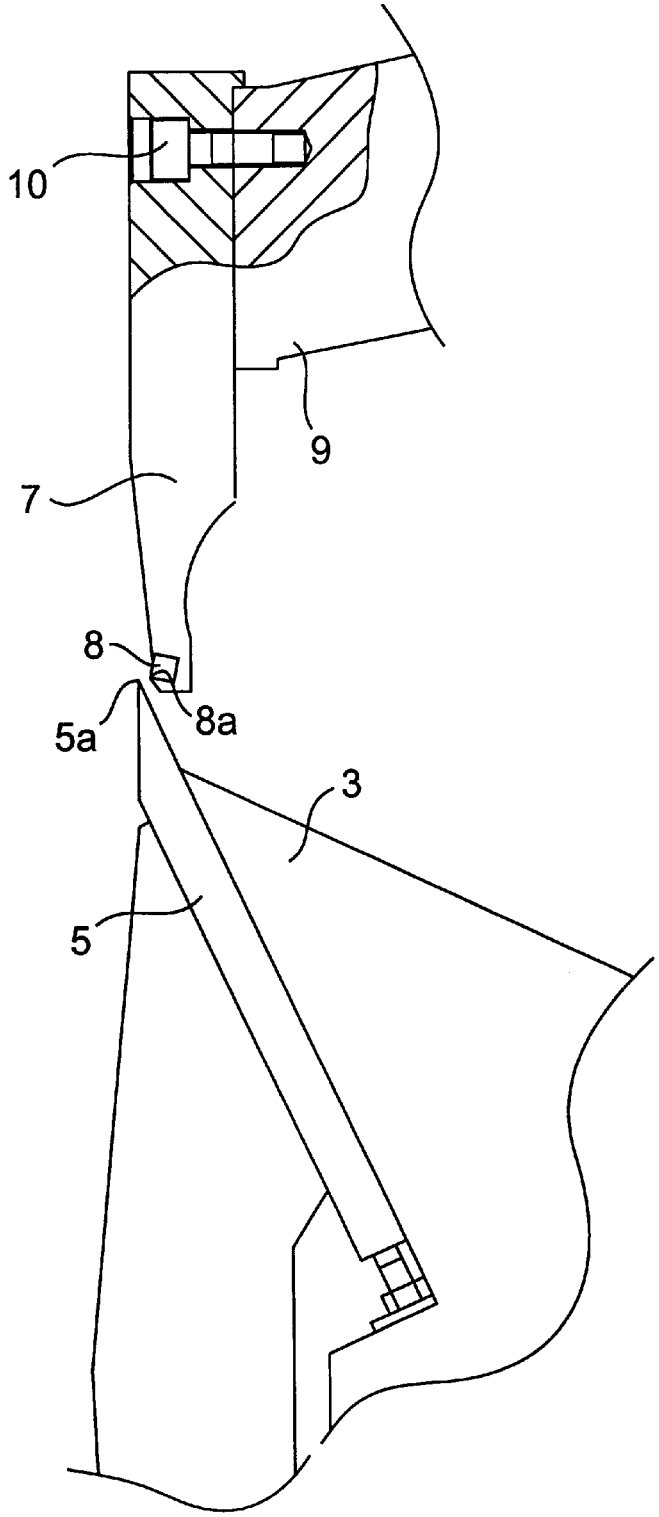
Fig. 2 (Prior Art)
FIG. 2 is a side view similar to FIG. 1, showing a condition wherein a nose bar is positioned with its front edges located clear of the cutting edge of the knife.
Figure 3:
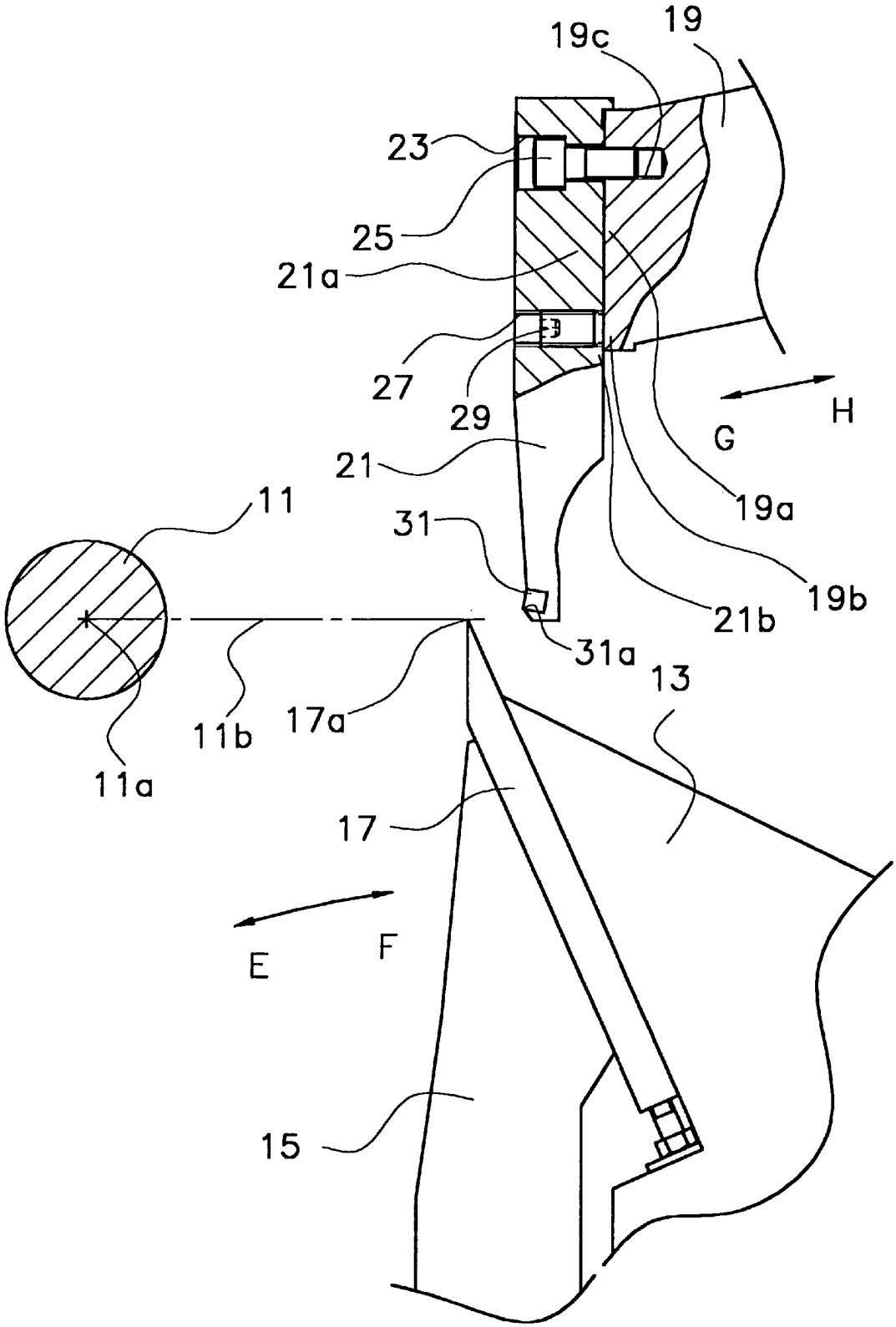
FIG. 3 is a partial, sectional, fragmentary side view showing a preferred embodiment of nose bar device constructed according to the present invention and general arrangement of elements.

The veneer lathe shown in FIG. 3 has a pair of spindles 11 (only one being shown in cross section), rotatably supported by bearings (not shown) and movable in an axial direction toward and away from each other for holding therebetween and releasing therefrom a peeler log (not shown) in a known manner. The veneer lathe further includes a veneer peeling knife 17 extending across the veneer lathe in parallel to the axis 11*a* of the spindles 11 and having at its tip end a horizontal cutting edge 17*a*. The veneer knife 17 is fixed to a mounting block 13, which forms a part of a knife carriage of the lathe, by a knife clamp 15 which is swingable toward and away from the knife 17, as indicated by double-headed arrow E–F, for holding and releasing the knife 17 to and from the block 13, respectively. As shown in FIG. 3, the knife 17 is fixed such that its cutting edge 17*a* is located just on a horizontal plane 11*b* passing through the axial center line 11*a*of the paired spindles 11. The veneer lathe further has a number of nose bars 21 juxtaposed at a predetermined interval adjacent to and along the cutting edge 17*a* of the knife 17 and clamped to a nose bar mounting block 19 which also forms a part of the knife carriage which is movable toward and away from a peeler log supported between the spindles 11. As indicated by double-head arrow G–H, the nose bar mounting block 19 is movable independently of the knife carriage.

Each nose bar 21 has formed therethrough at a position adjacent to its upper end a stepped hole 23 extending substantially in the direction in which the knife carriage moves, for receiving therein a screw 25 for fastening the nose bar 21 to the surface 19*a* of the nose bar mounting block 19. For fastening the nose bar 21, the screw 25 inserted through the hole 23 is screwed with an appropriate tightening torque into an internally threaded hole 19*c* which is formed in the nose bar mounting block 19. The screw 25 illustrated in FIG. 3 takes the form of a hexagon socket head screw or bolt so that its head lies within the hole 23 and does not interfere with a peeler log. As is apparent from the drawing, tightening the screw 25 into the threaded hole 19*c*, the screw head presses against the stepped portion in the hole 23, thereby fixing the nose bar 21 to its mounting block 19. An internally threaded hole 27 is formed through the nose bar 21, extending in parallel to the hole 23 at a position vertically spaced therefrom adjacent to the lower end portion 19*b* of the nose bar mounting block 19, in which an adjusting screw 29 is threadingly inserted. The screw 29 takes the form of a hexagon socket head set screw and is disposed within its threaded hole 27 for the same reason as in the case of the above fixing screw 25. The adjusting screw 29 is movable into contact with the surface 19*a* at the lower end portion 19*b* of the nose bar mounting block 19 and is capable of pressing against the surface 19*a* by being turned further in the direction which causes the screw 29 to advance, or to move rightward as seen in FIG. 3.

Figure 13A:
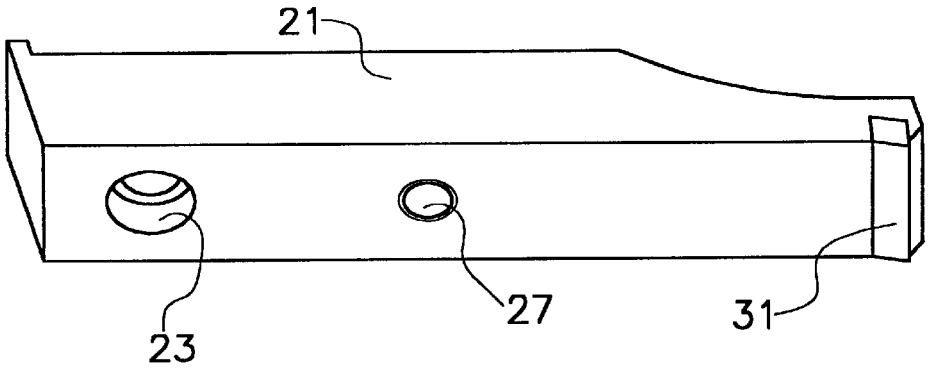
FIGS. 13(*a*), 13(*b*) and 13(*c*) show three different nose bars as examples which are all applicable to the nose bar device of the invention.
Figure 13B:
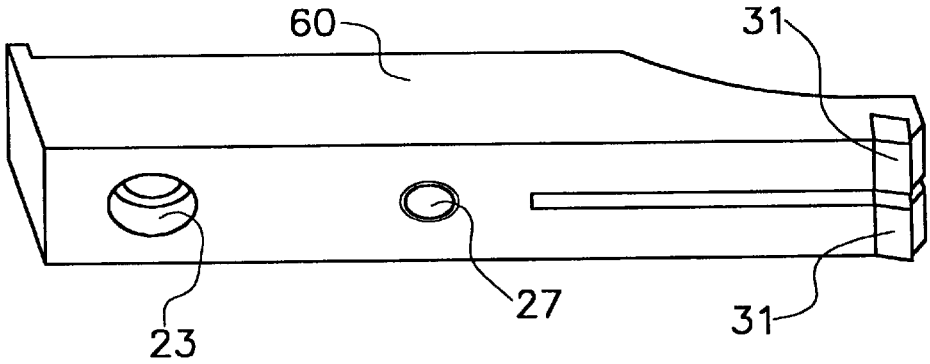
Figure 13C:
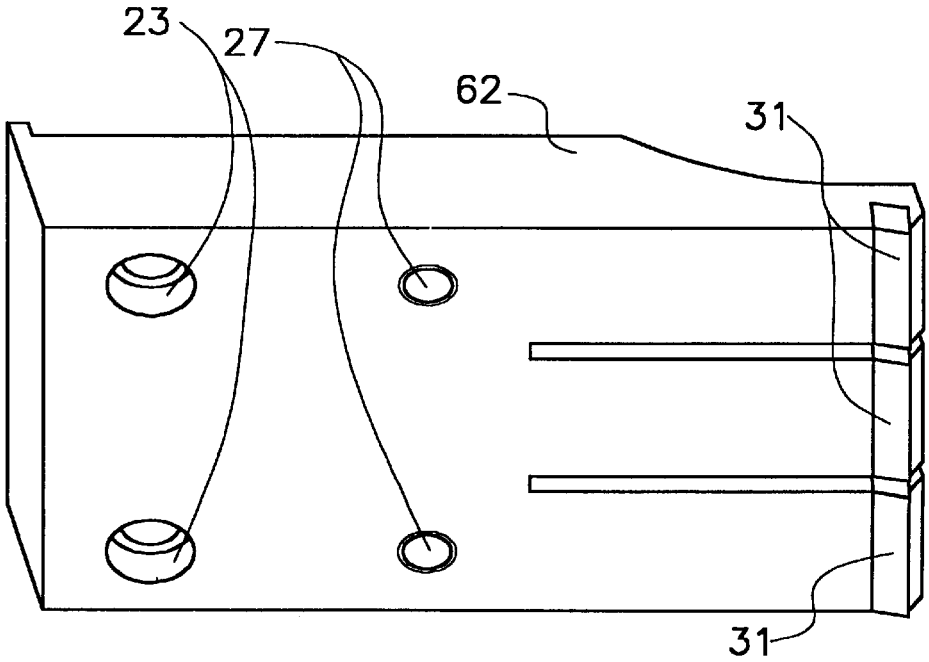

Each nose bar 21 has formed at the lowermost end of the free end portion on the side facing the knife cutting edge 17*a* a groove with a full width of the nose bar 21 in which a pressure portion in the form of an insert 31 is fitted, as shown also in FIG. 13(*a*), for pressing against a peeler log adjacent to and immediately ahead or upstream of the knife cutting edge 17*a* as seen in the direction in which the log is rotated. Reference symbol 31*a* designates a straight front edge of the insert 31, extending in parallel to the cutting edge 17*a* of the knife 17. The insert 31 is made of a hard and wear resistant material such as cemented carbide, ceramic, etc. and has the same width as the nose bar body, measuring about 30 mm. As will be understood by those skilled in the art, the insert 31 may be fixed into the groove either permanently, for example, by brazing, or detachably, by using an adhesive such as a cyanoacrylate glue.

Figure 4:
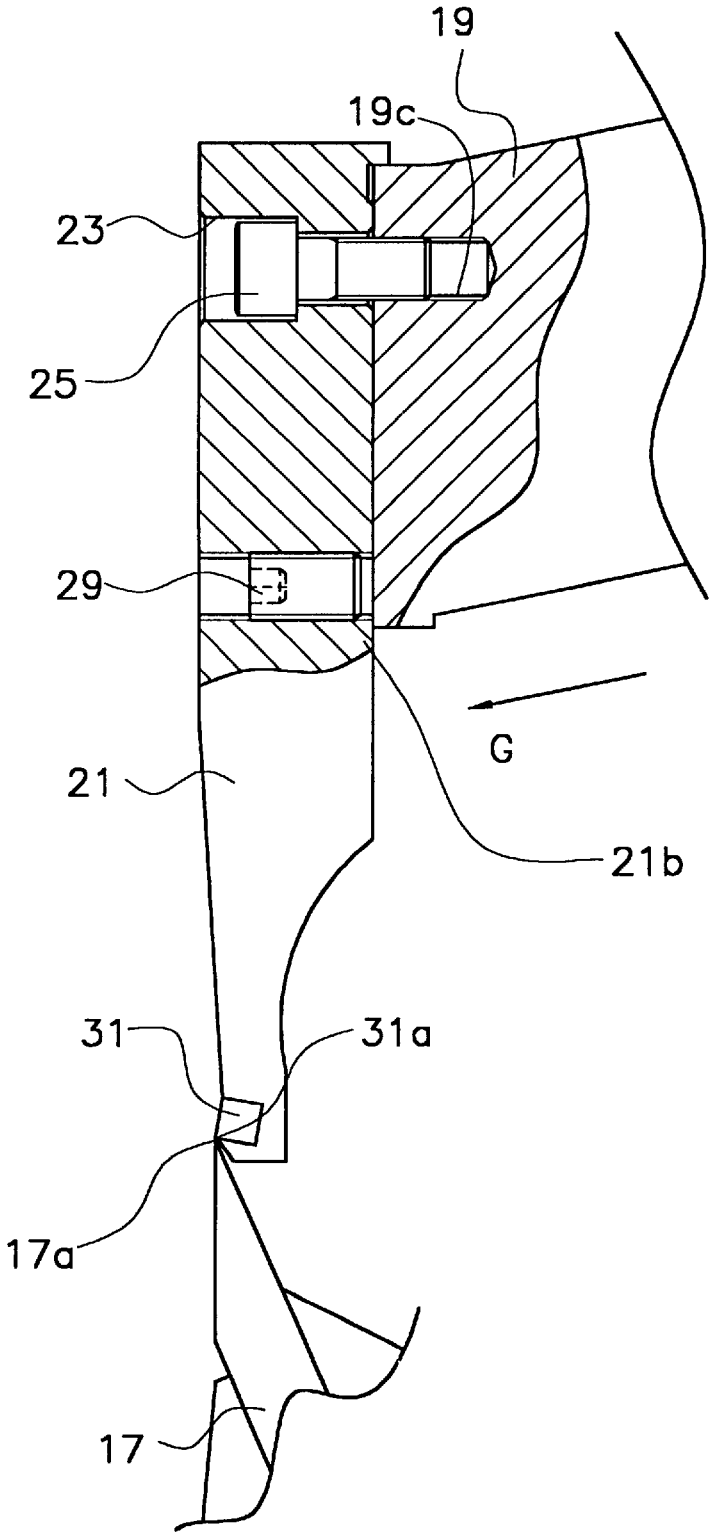
FIG. 4 is similar to FIG. 3, but shown in a larger scale and showing a condition wherein the front edge of a nose bar is brought just into alignment with the cutting edge of a veneer peeling knife.
Figure 5:
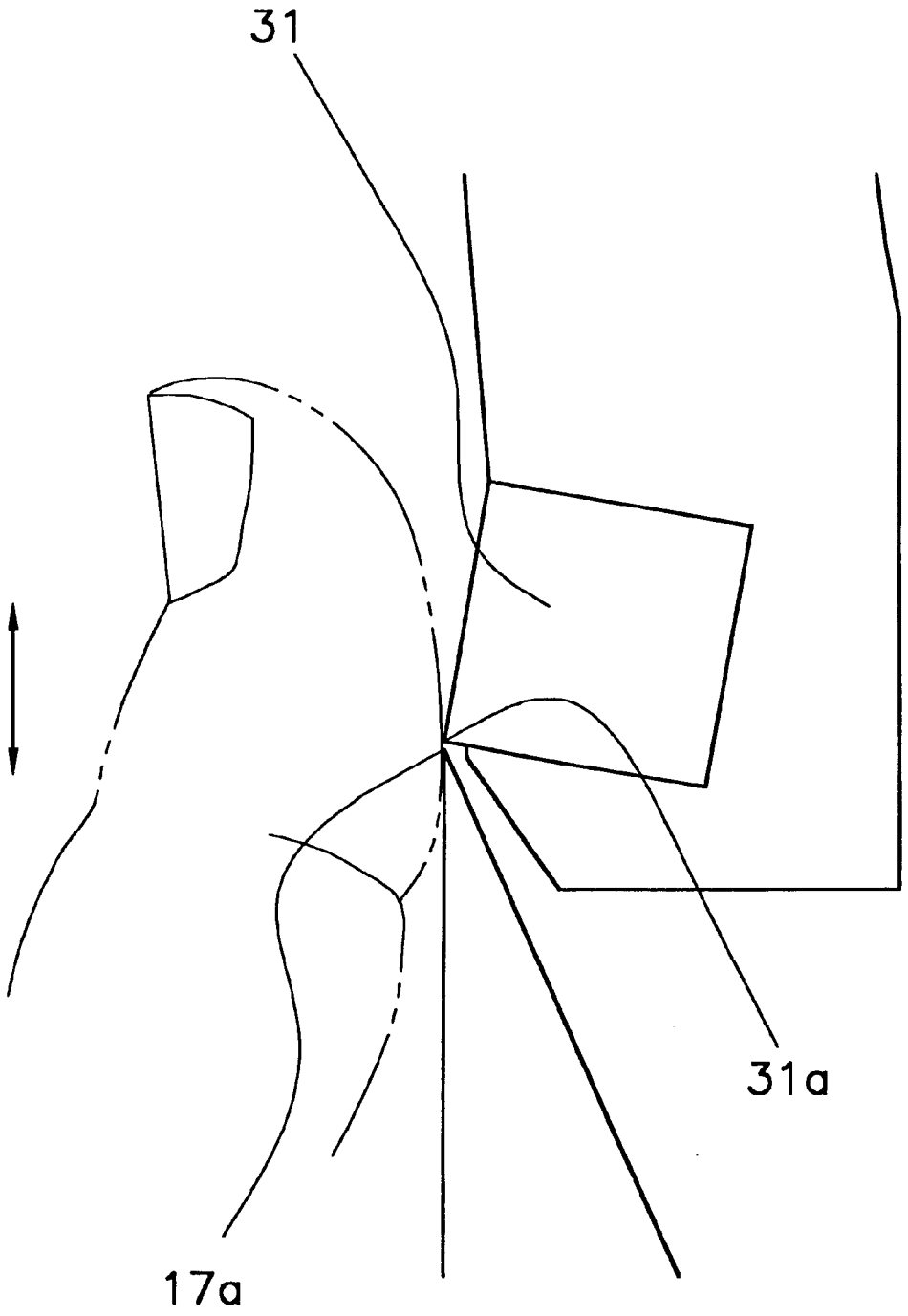
FIG. 5 is an enlarged side view showing a method of confirming alignment between the nose bar front edge and the cutting edge of the veneer knife.

The following will describe steps of a procedure for setting the nose bars 21 with respect to the cutting edge 17*a* of the knife 17. Firstly, the nose bar mounting block 19 is moved in the arrow direction G until the front edge 31*a* of the insert 31, which was then closest to the knife cutting edge 17*a,* is brought to an edge-to-edge alignment position wherein the front edge 31*a* of the nose bar 21 is just positioned in a vertical plane passing through the cutting edge 17*a* of the veneer knife 17, as shown in FIG. 4. In practice, such edge-to-edge alignment can be confirmed by placing the ball of finger against the front edge 31*a* of the nose bar 21 and the cutting edge 17*a* of the knife 17 and then moving the finger up and down as indicated by the double-headed arrow in FIG. 5. It can be considered that alignment has been accomplished if no scratchy edge is felt by the finger.

Figure 6:
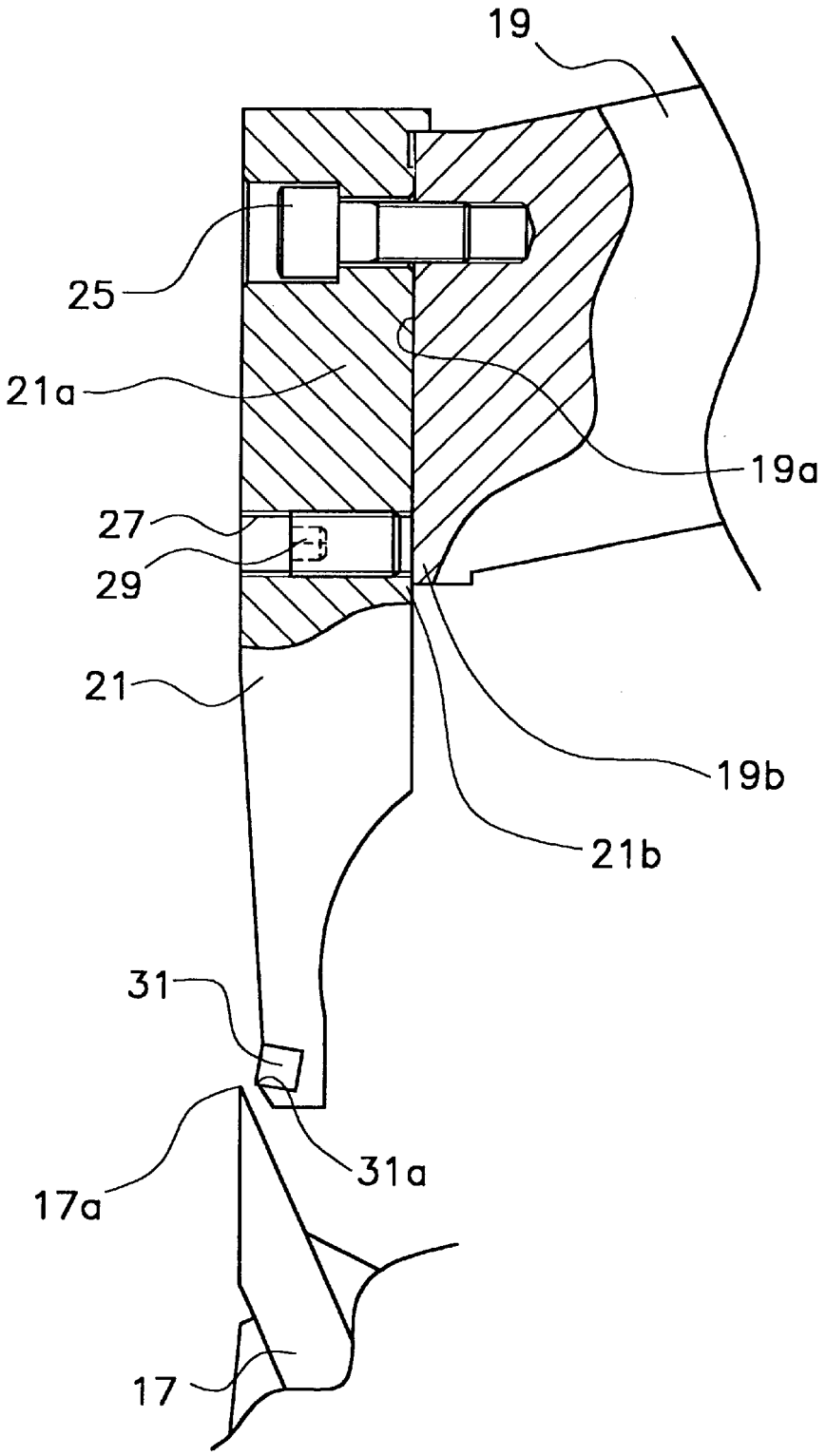
FIG. 6 is similar to FIG. 4, but showing a nose bar which is yet to be adjusted for alignment.
Figure 7:
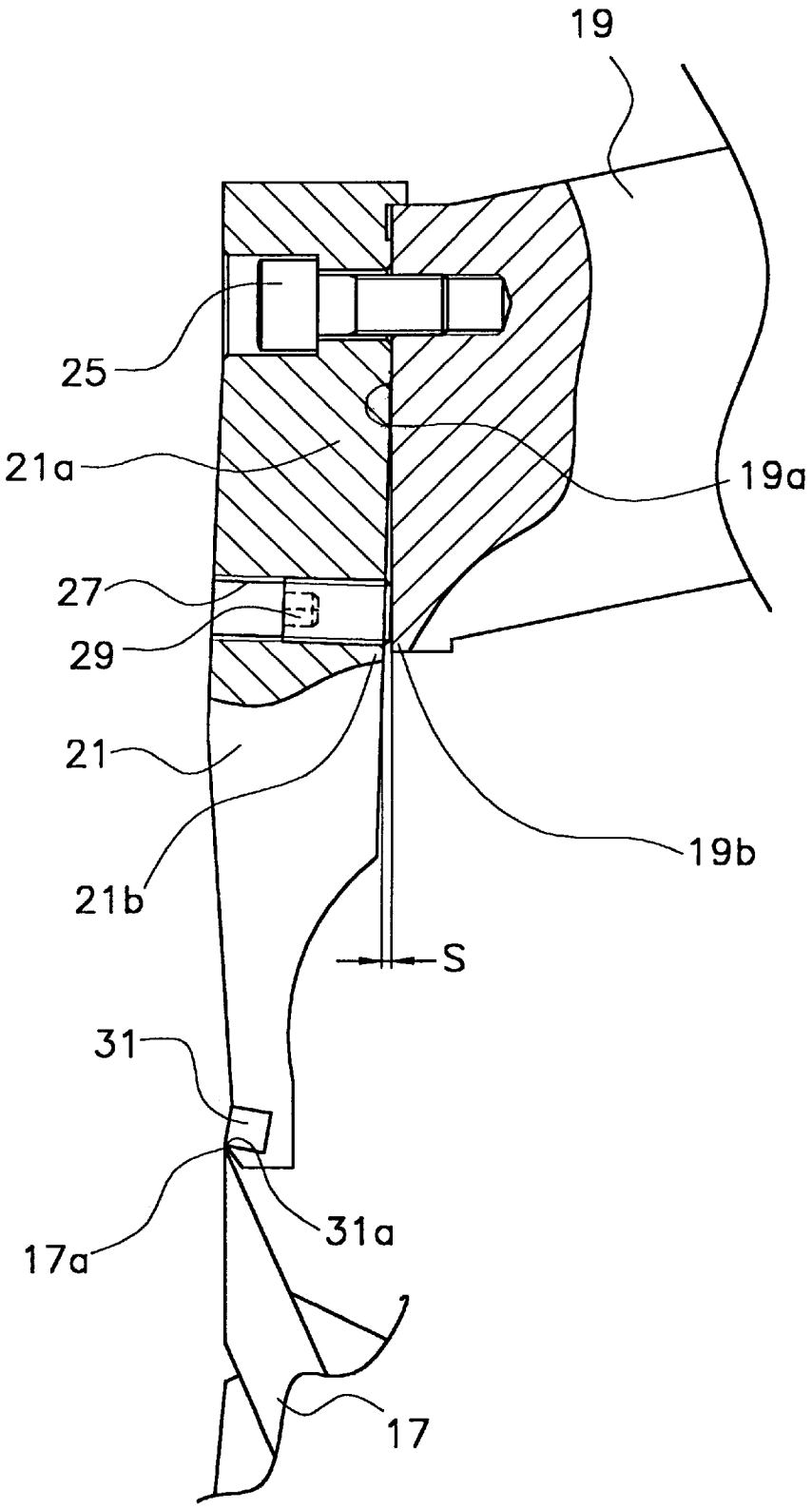
FIG. 7 is similar to FIG. 6, but showing a state wherein the nose bar of FIG. 6 has been adjusted for edge-to-edge alignment.

FIG. 6 shows a positional relationship of the other nose bars 21 relative to the knife cutting edge 17*a*, wherein the front edges 31*a* of the nose bars 21 are spaced apart from the cutting edge 17*a* of the knife 17. For each of these nose bars 21, the adjusting screw 29 is turned with an Allen wrench so as to move the screw 29 inward, or rightward as seen in FIG. 6. By so doing, the inner end of the adjusting screw 29 is first brought into contact with the surface 19*a* of the nose bar mounting block 19 and is then forced against the surface 19*a*. Since the nose bar 21 is fixed to its mounting block 19 at a position adjacent to the upper end thereof and the mounting block 19 is more rigid than the nose bar 21, moving the adjusting screw further inward causes the nose bar 21 to be deformed or bent in such a way that the portion thereof below the fixing screw 25 is deflected away from the surface 19*a* of the nose bar mounting block 19 with a space designated by S formed between the nose bar 21 and the block 19 at the lower end 19*b* of the nose bar mounting block 19, as clearly shown in FIG. 7. As is apparent from the drawing, the deflecting amount of the nose bar 21 represented by the distance S at the position 19*b* depends on the distance of projection of the adjusting screw 29 beyond the right-hand side end of the threaded hole 27. Turning of the adjusting screw 29 is continued while checking for edge-to-edge alignment with a finger, as described with reference to FIG. 5, until the desired alignment is achieved, as shown in FIG. 7. Such adjustment is performed repeatedly for each of the remaining nose bars 21.

Subsequently, the nose bar mounting block 19 is moved in H direction (FIG. 3) to a position where the spaced distance as seen in the horizontal direction between the front edge 31*a* of the insert 31 and the cutting edge 17*a* of the veneer knife 17 corresponds to, for example, about 90% of the thickness of veneer sheet to be peeled by the veneer lathe. Thus, all nose bars 21 can be positioned with substantially the same desired edge-to-edge distance between the edges 31*a* of the nose bars 21 and the cutting edge 17*a* of the veneer knife 17.

As will be understood by those skilled in the art, there may occur a condition wherein any nose bars 21 are stricken by a log by accident during log loading operation, with the result that such nose bars may be deformed with its lower end portion bent away from the knife cutting edge 17, as discussed above with reference to the prior art device. The nose bar device according to the present invention is capable of coping with such misalignment by adjustment of the screw 29 as described above, provided that the bending of the nose bar 21 is within an adjustable range.

In the above embodiment, the right end of the adjusting screw 29, as seen in FIG. 7, is in direct contact with the surface 19*a* of the nose bar mounting block 19. To protect the surface 19*a* from scratches causes by the contact, any suitable protective means, such as a seat plate, may be located between the adjusting screw 29 and the surface 19*a*.

It is noted that the present invention is not limited to the above preferred embodiment, but it can practiced in other various forms and arrangements, as exemplified in the following, wherein elements corresponding to elements of the above embodiment are designated by like reference symbols or numerals.

Figure 8:
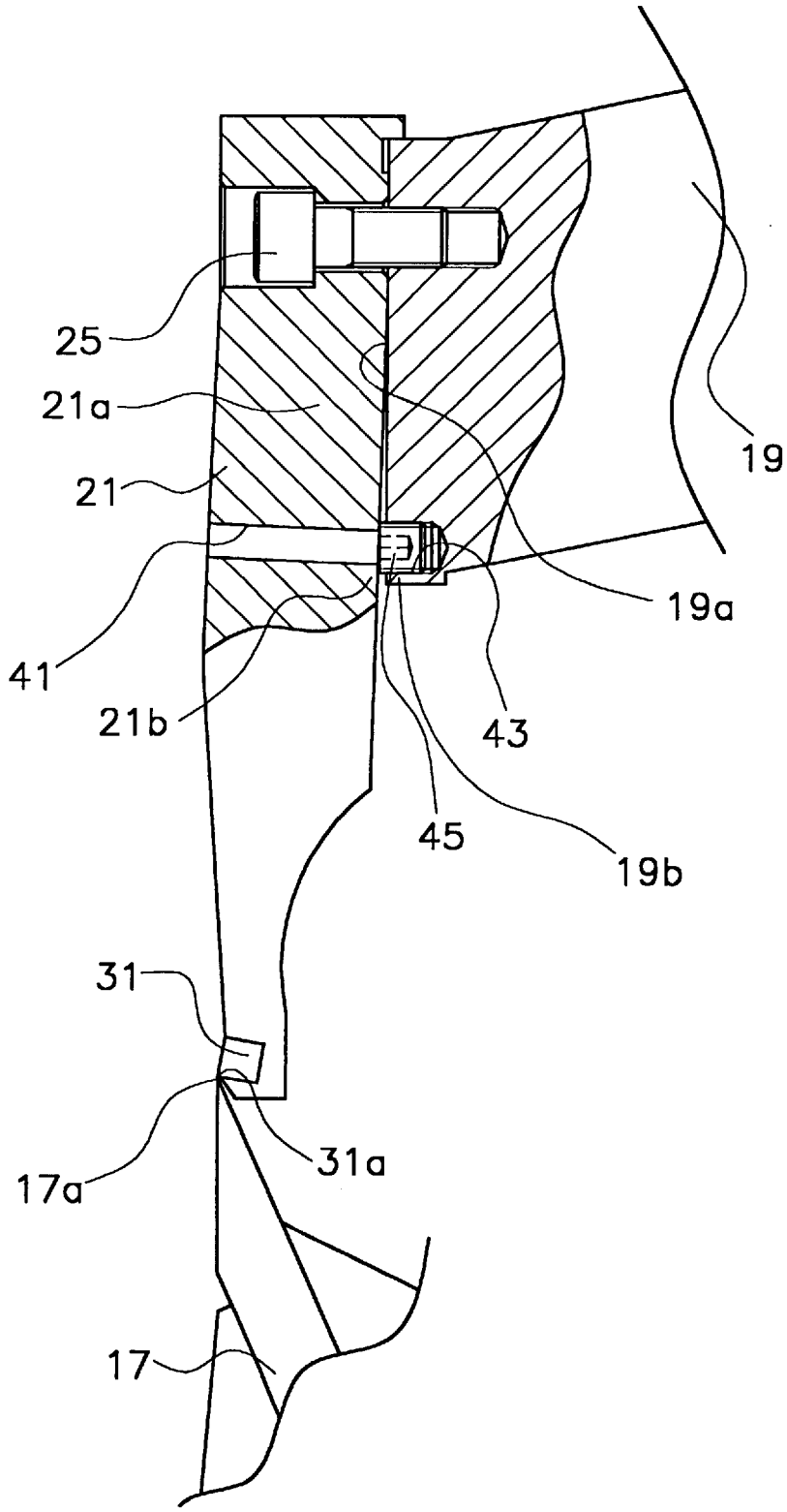
FIG. 8 is a partial, sectional, fragmentary side view showing an modified embodiment of nose bar device according to the invention.

FIG. 8 shows a first modified embodiment, which differs from the preferred embodiment in that an adjusting screw is provided not in the nose bar 21, but in the nose bar mounting block 19 of the knife carriage. As shown, the nose bar 21 has formed therethrough a hole 41 extending in parallel to the hole 23 in which the fixing screw 25 is inserted, while the nose bar mounting block 19 has formed therein an internally threaded hole 43 positioned in axial alignment with the hole 41 and receiving therein an adjusting screw 45 in the form of a set screw with a hexagon socket head. In adjusting the nose bar 21, an Allen wrench is inserted through the hole 41 to fit into the hexagon socket of the adjusting screw 45. For moving the insert 31 of the nose bar 21 for alignment of its front edge 31*a* with the knife cutting edge 17*a*, the screw 45 is turned in the direction that causes the screw 45 to move outward, or leftward as seen in FIG. 8, from the threaded hole 43. By so doing, the adjusting screw 45 is forced against the inner surface of the nose bar 21, which is then deformed or bent so as to move its insert 31 toward the knife cutting edge 17*a*. As a matter of course, for the adjusting screw 45 to press against the nose bar 21, the diameter of the hole 41 must be smaller than the outer diameter of the screw 45.

Figure 9:
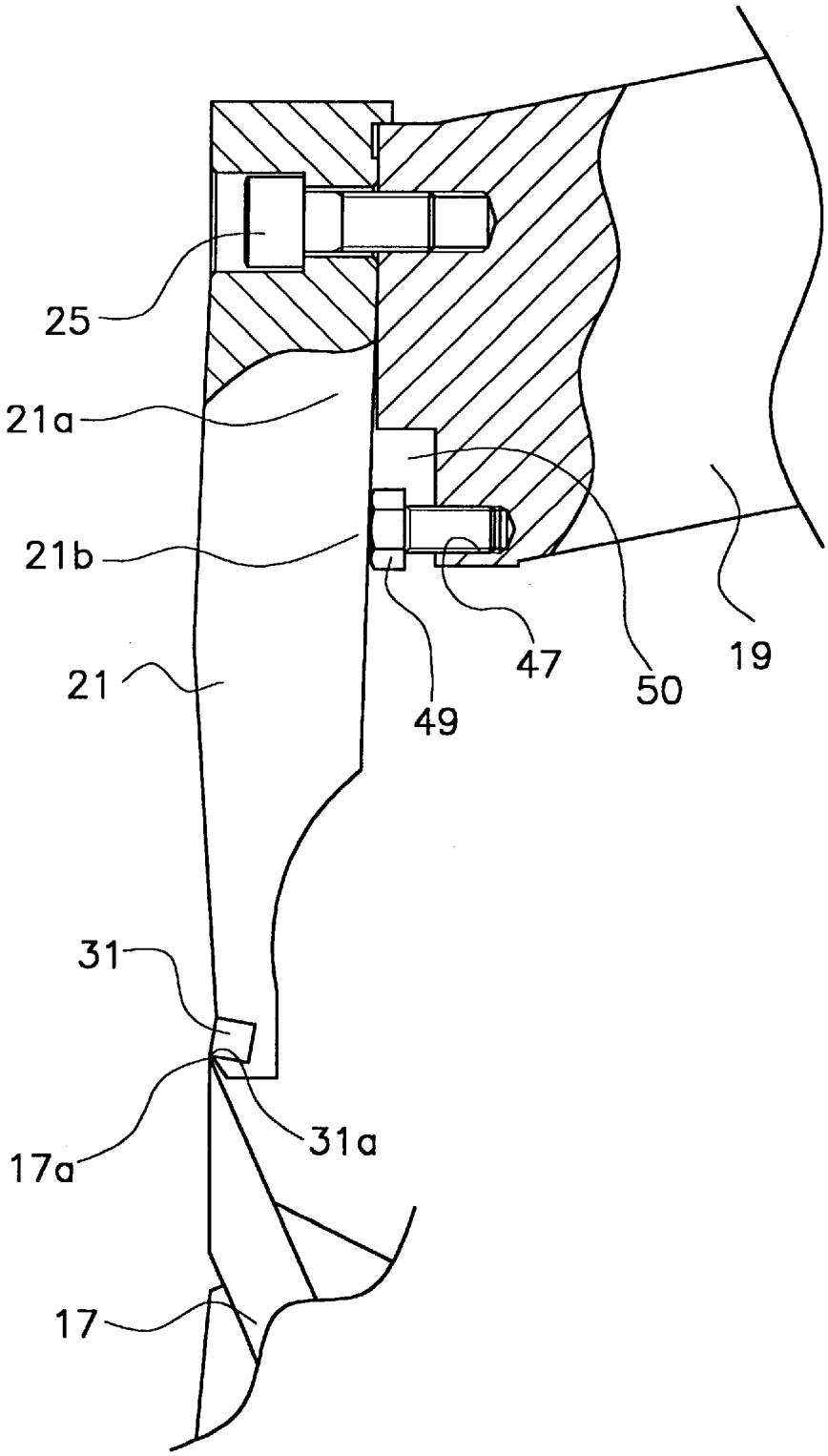
FIG. 9 shows another modified embodiment of nose bar device according to the invention.

FIG. 9 shows a modification of the above embodiment of FIG. 8, which differs therefrom in that the hole 41 in the nose bar 21 is omitted and the adjusting screw 45 is substituted by a screw 49 in the form of a bolt having a hexagon head. For this purpose, the nose bar mounting block 19 is cut at the bottom thereof adjacent to the nose bar 21 so as to provide a space 50. An internally threaded hole 47 is formed open to the space 50. An adjusting screw 49 is threadingly disposed in the hole 47. The adjusting screw 49 is movable by turning its hexagon head with a wrench. Thus, the hexagon head of the screw 49 is contactable with the back side surface of the nose bar 21 and further turning the screw 49 causes the nose bar to be deformed or deflected away from the nose bar mounting block 19, thereby causing the nose bar edge 31*a* to move toward the knife edge 17*a*.

Figure 10:
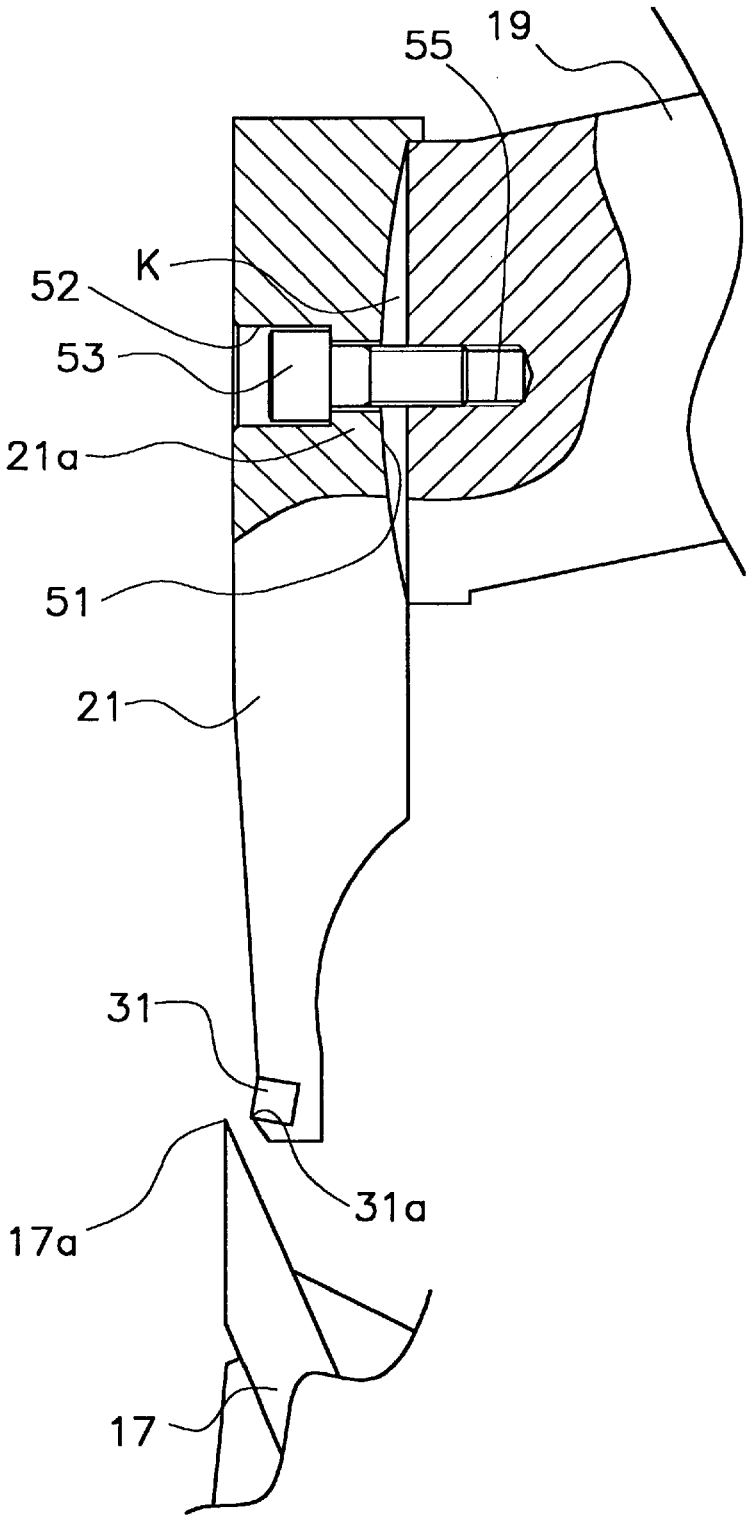
FIGS. 10 to 12 are partial, sectional, fragmentary side views showing three different variations of modified embodiments of nose bar devices constructed according to the invention.
Figure 11:
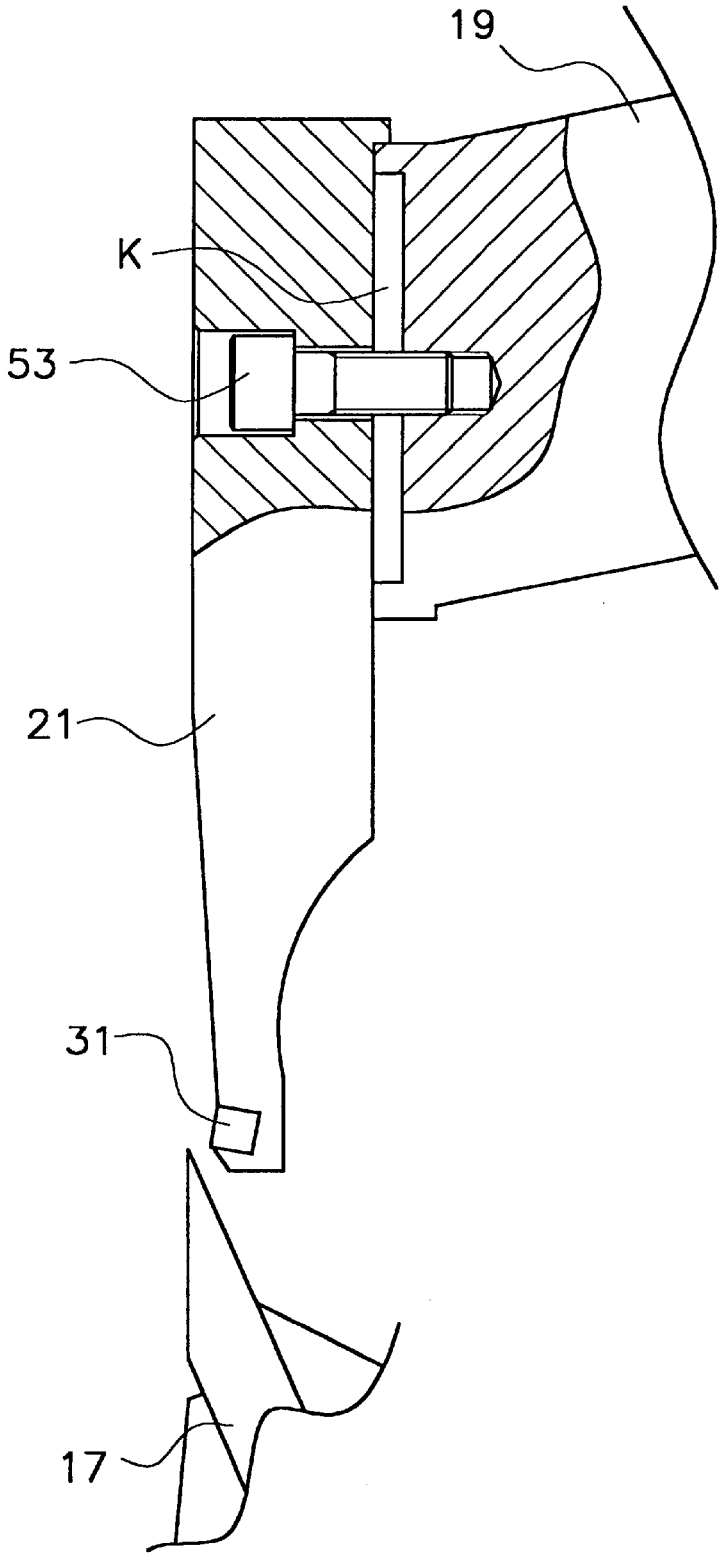
Figure 12:
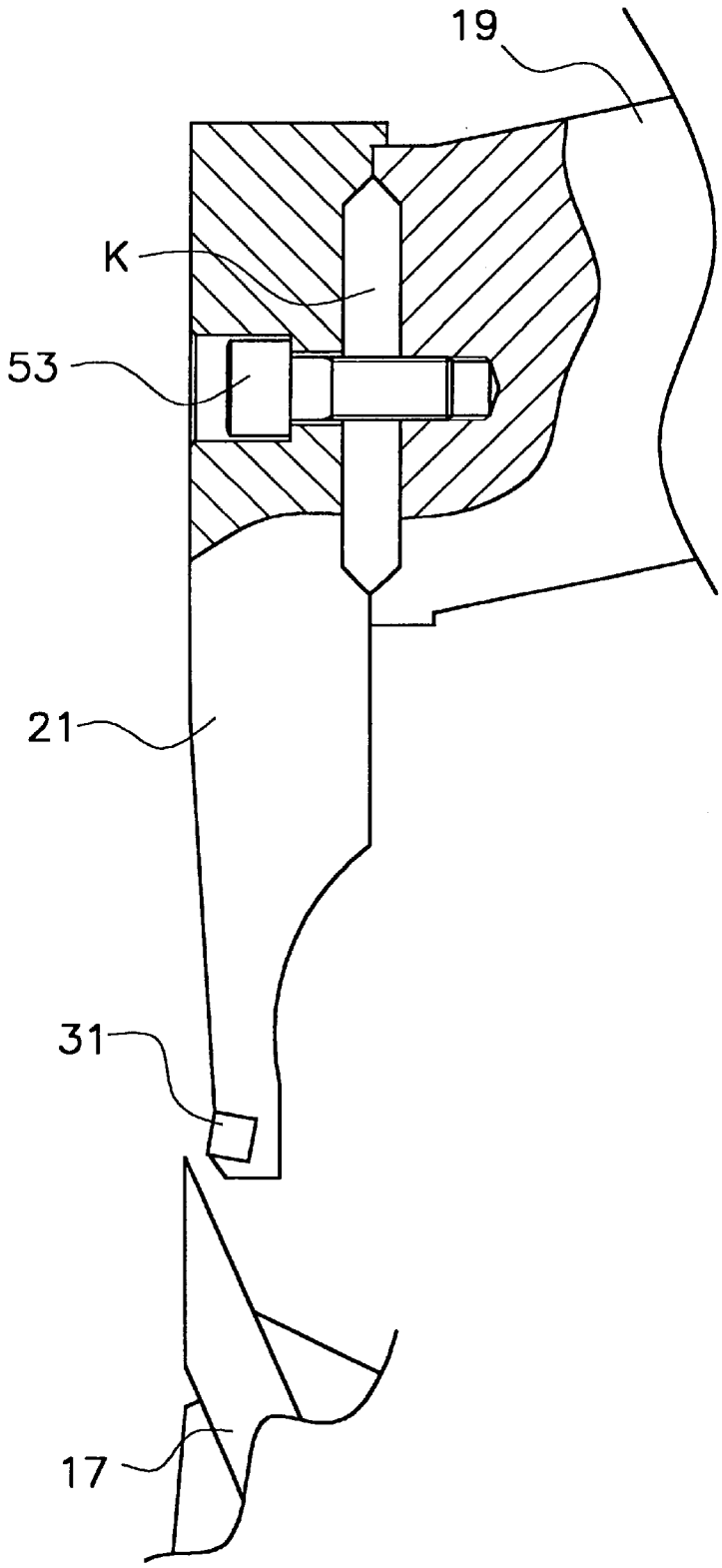

Referring now to FIGS. 10 to 12, these three embodiments operate on the same principle in that the nose bar 21 is mounted to the nose bar mounting block 19 at two points, as seen in cross section, which are vertically spaced apart so that forcing the nose bar 21 toward its mounting block 19 at an intermediate position between the two supporting points causes the nose bar to be deformed or bent so as to move the front edge of the nose bar 21 at the tip end of the free end portion thereof toward the cutting edge 17*a* of the knife 17.

Referring to FIG. 10, the upper mounting portion 21*a* of the nose bar 21 is cupped or formed with an arcuate recess 51 extending throughout its width so that the nose bar 21 is supported on the mounting block 19 at two points as seen in cross section and that a space K is formed between the inner surfaces of the mounting portion 21*a* of the nose bar 21 and the nose bar mounting block 19, respectively, when the nose bar 21 is installed in place to the block 19. The nose bar 21 has formed therethrough a stepped hole 52 at an intermediate position between the upper and lower supporting points, while the nose bar mounting block 19 has formed therein an internally threaded hole 55 axially aligned with the hole 52 when the nose bar 21 is set in place with respect to the mounting block 19. A hexagon socket head screw 53 is inserted through the hole 52 and screwed into the threaded hole 55, as shown in FIG. 10, with an appropriate tightening torque for fixing the nose bar 21 to its mounting block 19.

As in the first preferred embodiment of FIGS. 3 to 7, the nose bar mounting block 19 is moved in the arrow direction G (FIG. 4) until the edge 31*a* of an insert 31, which was closest to the cutting edge 17*a* of the knife 17 before the movement of the mounting block 19, is brought into alignment with the knife cutting edge 17*a*. For each of the remaining nose bars 21 which need be moved for adjustment, the screw 53 is tightened with an Allen wrench so as to move the screw 53 inward, or rightward as seen in FIG. 10. By so doing, the head of the screw 53 presses against the stepped portion of the hole 52 and the upper mounting portion 21*a* of the nose bar 21 is forced toward the nose bar mounting block 19 to be deformed in such a way that the volume of the space K is reduced. Therefore, the lower free end portion of the nose bar 21 is deflected leftward to move the insert 31 toward the knife 17. The screw 53 is continued to be tightened while checking for edge-to-edge alignment with a finger as described with reference to FIG. 5, until the front edge 31*a* of the nose bar 21 is brought into alignment with the cutting edge 17*a* of the knife 17. Such adjustment is repeated for each of the remaining nose bars 21. Then, the nose bar mounting block 19 is moved in H direction (FIG. 3) to a position where the desired spaced distance between the nose bar edge 31*a* and the knife cutting edge 17*a* corresponds to, for example, about 90% of the thickness of the veneer sheet to be peeled by the veneer lathe.

FIG. 11 shows a modification of the above embodiment of FIG. 10, wherein a recess is formed not in the nose bar 21, but in the nose bar mounting block 19. As shown in the drawing, the recess is formed so as to provide a space K having an elongated rectangular shape as seen in cross section.

FIG. 12 illustrates another modification of the embodiment of FIG. 10, wherein recesses are formed in both of the nose bar 21 and its mounting block 19. As shown in the drawing, the recesses are formed so as to provide a space K corresponding to a combination of two trapezoids as seen in cross section.

In the above embodiments shown in FIGS. 10 to 12, the recess either in the nose bar 21 or in the nose bar mounting block 19 may be of any shape as long as a space is formed between the nose bar 21 and its mounting block 19, which makes possible deformation of the nose bar and deflection of its lower free end portion, thereby moving the insert 31 toward and away the knife 17.

FIGS. 13(*a*), 13(*b*) and 13(*c*) exemplify three different forms of nose bars which are all applicable to the device according to the present invention. FIG. 13(*a*) shows a nose bar 21 which has been described with reference to the preferred embodiment of FIGS. 3 to 7, comprising a single nose bar body having a hole 23, a threaded hole 27 and an insert 31. As mentioned already, this nose bar 21 measures about 30 mm in width. FIG. 13(*b*) shows a nose bar 60 comprising a nose bar body formed therethrough with a single hole 23 and a threaded hole 27, but having bifurcated lower free end portions each having an insert 31. This nose bar 60 may be made by cutting a slit in the lower end portion of the nose bar 21 of FIG. 13(*a*) and, therefore, the width of the nose bar 60 itself measures about 30 mm. FIG. 13(*c*) shows another form of a nose bar which is divided into three free end portions, each having an insert 31, and has formed therethrough two sets of holes 23 and threaded holes 27. This nose bar 62 measures about 95 mm in width. As will be understood by those skilled in the art, the nose bars 60, 62 shown in FIGS. 13(*b*) and 13(*c*) may be used in a rotary veneer lathe having a peripheral drive system wherein a series of toothed drive wheels is disposed adjacent to the veneer knife and nose bars, as shown in FIGS. 14 and 15.

Figure 14:
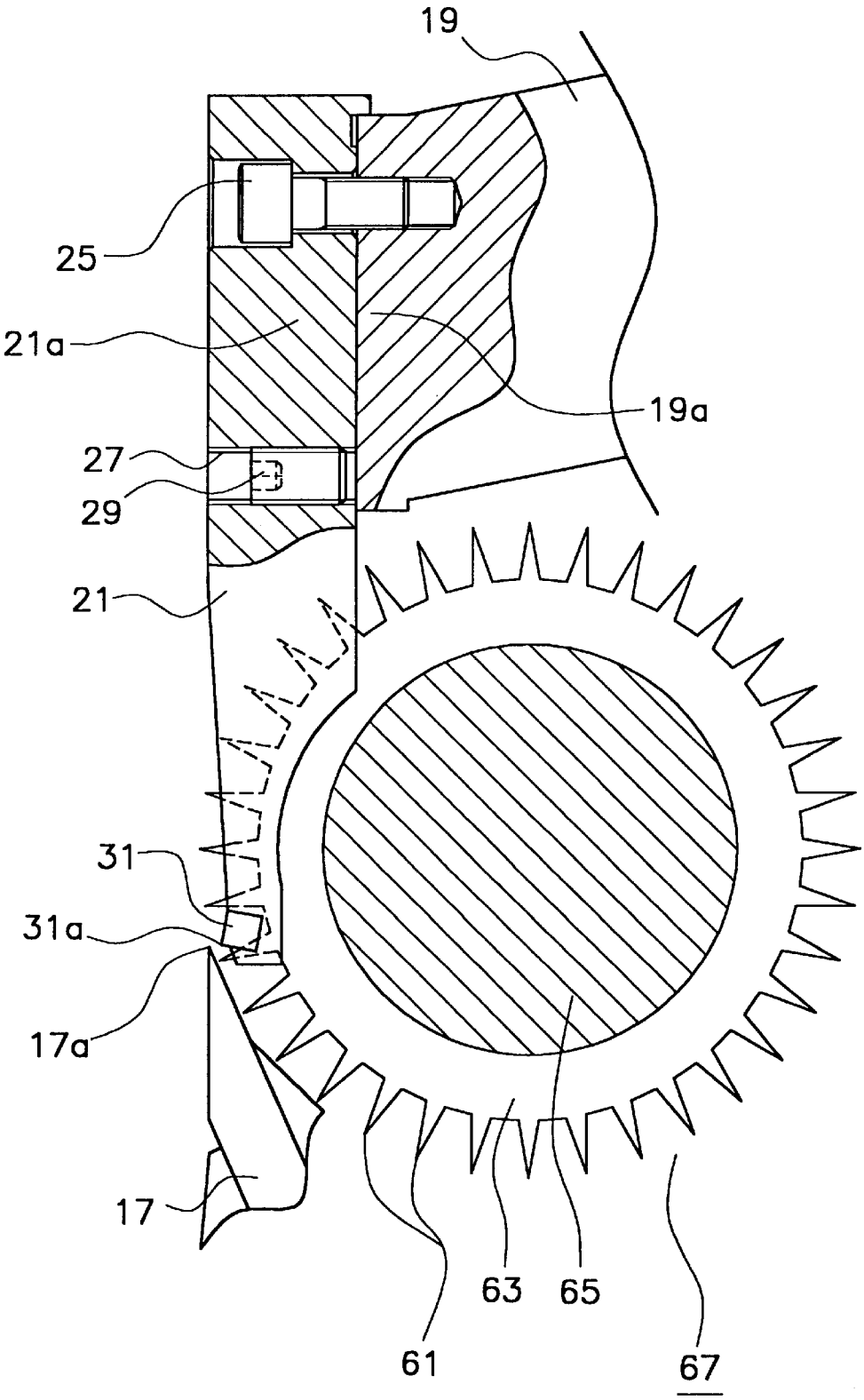
FIG. 14 is a partial, sectional, fragmentary side view showing an application of the nose bar device of the invention to a rotary veneer lathe which is equipped with a peripheral drive system.
Figure 15:
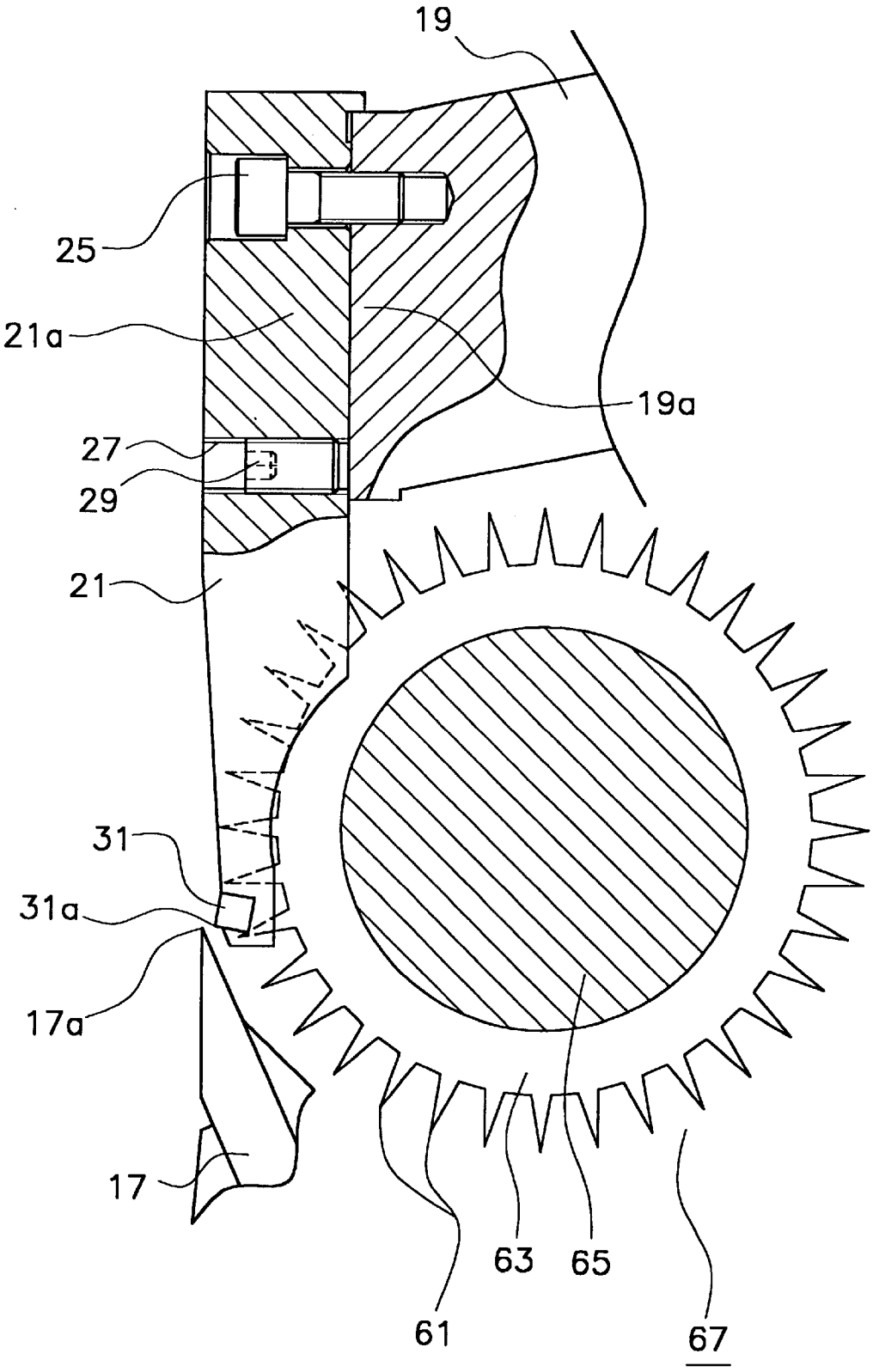
FIG. 15 is similar to FIG. 14 showing a different state of the peripheral drive system.

FIGS. 14 and 15 show an application of the nose bar device according to the invention to a rotary veneer lathe equipped with a peripheral drive system which includes a series of toothed drive wheels 63 mounted on a common drive shaft 65 at a spaced interval and each having on the periphery thereof a number of pointed projections or teeth 61 which are engageable with log periphery for driving the peeler log. In such type of rotary veneer lathe, nose bars 60 or 62 may be used so that during operation some of the toothed drive wheels 63 are disposed such that their teeth 61 are rotated past the slits of nose bars 60 or 62. FIG. 14 shows a state wherein the drive wheels 61 are positioned with their teeth 61 projecting beyond the front surface of the nose bars for engagement with the log periphery, while FIG. 15 illustrates a state wherein the drive wheels 61 are moved to their retracted position so as to render the peripheral drive inoperative. Such a retracted position is preferred when producing a veneer sheet whose surface quality is an important concern.

It is noted that adjusting mechanism for moving the insert 31 relative to the knife cutting edge 17*a* by causing the nose bar to be bent does not necessarily have be provided for all nose bars, but for two or three or even more nose bars 21, depending on the quality requirement of the veneer sheet to be peeled by the veneer lathe. It is desirable, however, that each nose bar has its own adjusting mechanism. It is also to be noted that the present invention is applicable not only to rotary veneer lathes, but also to other veneer cutting apparatuses such as a veneer slicer.

As is apparent from the foregoing description, the nose bar device according to the invention permits precise adjustment of individual nose bars for optimum nose bar setting with respect to the cutting edge of a veneer peeling knife by using a simple mechanism. This feature of the invention is highly advantageous particularly in cutting relatively thin veneer sheet with the desired quality.

While the invention has been described and illustrated with reference to the specific embodiments, it is to be understood that the present invention can be practiced in other various changes and modifications without departing from the spirit or scope thereof.

What is claimed is:

1. A nose bar device in a rotary veneer lathe for peeling a wood veneer sheet from a rotating log, said lathe having a knife carriage movable toward and away from the log and a knife mounted on said knife carriage and having at the tip end thereof a cutting edge extending horizontally across the direction in which said knife carriage is moved, the nose bar device comprising:

a plurality of nose bars juxtaposed along the cutting edge of said knife, mounted to a part of said knife carriage, each of the nose bars having at the lower end thereof a pressure edge located adjacent to said cutting edge of said knife and having a width extending parallel to the cutting edge of said knife for pressing against the log adjacent to the cutting edge of said knife, said nose bar mounting part of the knife carriage being movable independently of said knife carriage; and an adjusting mechanism for independently adjustably moving the pressure edge of at least one of said nose bars toward and away from the cutting edge of said knife.

2. A nose bar device according to claim 1, fiber comprising a fastener for fixing said at least one nose bar to said nose bar mounting part at a position adjacent to the upper end of said at least one nose bar, and wherein said adjusting mechanism includes means for adjustably moving said pressure edge of said at least one nose bar toward and away from the cutting edge of said knife by causing said at least one nose bar to be deformed for displacement relative to said nose bar mounting part.

3. A nose bar device according to claim 2, wherein said moving means includes a screw disposed in a threaded hole which is formed through said at least one nose bar in the direction in which said knife carriage is moved at a position below said fastener where said screw is contactable with the surface of said nose bar mounting part adjacent to said at least one nose bar, and said screw is operable to cause said at least one nose bar to be deformed for displacement relative to said nose bar mounting part by pressing against said surface of said nose bar mounting part.

4. A nose bar device according to claim 3, wherein said at least one nose bar has formed therethrough a hole at said position adjacent to the upper end thereof for receiving therein said fastener, and said fastener includes a socket head screw whose head is disposed within said hole.

5. A nose bar device according to claim 3, wherein said screw includes a socket head set screw whose head is disposed within said threaded hole.

6. A nose bar device according to claim 2, wherein said moving means includes a screw disposed in a threaded hole which is formed in said nose bar mounting part of the knife carriage in the direction in which said knife carriage is moved at a position below said fastener where said screw is contactable with the surface of said at least one nose bar adjacent to said nose bar mounting part, and said screw is operable to cause said at least one nose bar to be deformed for displacement relative to said nose bar mounting part by pressing against said surface of said at least one nose bar.

7. A nose bar device according to claim 6, wherein said screw includes a socket head screw whose head is contactable with said surface of said at least one nose bar, said at least one nose bar has formed therethrough a hole extending substantially in axial alignment with said hole in said nose bar mounting part and having an inner diameter smaller than the outer diameter of said screw for providing an access to the head of said socket head screw.

8. A nose bar device according to claim 6, wherein said nose bar mounting part is formed with a cut so as to provide an open space in the region adjacent to said position where said screw is contactable with the surface of said at least one nose bar, said screw includes a bolt having a head, said screw being disposed in said threaded hole with its head contactable with said surface in said open space.

9. A nose bar device according to claim 1, further comprising a screw inserted through a hole which is formed through said at least one nose bar in the direction in which said knife carriage is moved and also into a threaded hole which is formed in said nose bar mounting part for fastening said at least one nose bar to said nose bar mounting part;

wherein said adjusting mechanism comprises said screw, said at least one nose bar and said nose bar mounting part forming a space therebetween such that said at least one nose bar is supported in contact with said nose bar mounting part at two vertically spaced positions when said at least one nose bar is fastened to said nose bar mounting part;

said screw being inserted through and into said hole and threaded hole respectively at a position intermediate between said two positions, said screw being operable to cause said at least one nose bar to be deformed in such a way as to reduce the volume of said space for displacement of said at least one nose bar relative to said nose bar mounting part by forcing against said at least one nose bar.

10. A nose bar device according to claim 9, wherein said screw includes a socket head screw whose head is disposed within said hole.

11. A nose bar device according to claim 9, wherein said space is provided by a recess which is formed in said at least one nose bar.

12. A nose bar device according to claim 9, wherein said space is provided by a recess which is formed in said nose bar mounting part.

13. A nose bar device according to claim 9, wherein said space is provided by recesses which are formed in both said at least one nose bar and said nose bar mounting part.

14. A nose bar device according to claim 1, wherein said at least one nose bar is divided at the portion thereof adjacent to the knife into at least two bar portions each having at the lower end thereof said pressure edge for pressing against the log adjacent to the cutting edge of said knife.

15. A nose bar device according to claim 1, wherein said moving mechanism is provided for each of said nose bars of the rotary veneer lathe.

16. A nose bar device according to claim 1, wherein said rotary veneer lathe comprises a peripheral drive system including a drive shaft extending across said veneer lathe and a series of toothed drive wheels mounted on said drive shaft at a spaced interval, each of the drive wheels having on the periphery thereof a number of pointed tooth-like projections which are engageable with the log periphery for driving the log.

17. A rotary veneer lathe for peeling a wood veneer sheet from a rotating log, comprising:.

a knife carriage movable toward and away from the log, a knife mounted on said knife carriage and having at the tip end thereof a cutting edge extending horizontally across the direction in which said knife carriage is moved, a plurality of nose bars juxtaposed along the cutting edge of said knife, mounted to a part of said knife carriage, each of said nose bars having at the lower end thereof a pressure edge located adjacent to said cutting edge of said knife and having a width extending parallel to the cutting edge of said knife for pressing against the log adjacent to the cutting edge of said knife, said nose bar mounting part of the knife carriage being movable independently of said knife carriage, and an adjusting mechanism for independently adjustably moving said pressure edge of at least one of said nose bars toward and away from said cutting edge of the knife.

18. A rotary veneer lathe according to claim 17, wherein said nose bar device further comprises a fastener for fixing said at least one nose bar to said nose bar mounting part at a position adjacent to the upper end of said at least one nose bar, and said adjusting mechanism includes means for adjustably moving said pressure edge of said at least one nose bar toward and away from the cutting edge of said knife by causing said at least one nose bar to be deformed for displacement relative to said nose bar mounting part.

19. A rotary veneer lathe according to claim 18, wherein said moving means includes a screw disposed in a threaded hole which is formed through said at least one nose bar in the direction in which said knife carriage is moved at a position below said fastener where said screw is contactable with the surface of said nose bar mounting part adjacent to said at least one nose bar, and said screw is operable to cause said at least one nose bar to be deformed for displacement relative to said nose bar mounting part by pressing against said surface of said nose bar mounting part.

20. A rotary veneer lathe according to claim 18, wherein said moving means includes a screw disposed in a threaded hole which is formed In said nose bar mounting part of the knife carriage in the direction in which said knife carriage is moved at a position below said fastener where said screw is contactable with the surface of said at least one nose bar adjacent to said nose bar mounting part, and said screw is operable to cause said at least one nose bar to be deformed for displacement relative to said nose bar mounting part by pressing against said surface of said at least one nose bar.

21. A rotary veneer lathe according to claim 17, further comprising a screw inserted through a hole which is formed through said at least one nose bar in the direction in which said knife carriage is moved and also into a threaded hole which is formed in said nose bar mounting part for fastening said at least one nose bar to said nose bar mounting part, said adjusting mechanism including said screw and said at least one nose bar and said nose bar mounting part forming a space therebetween such that said at least one nose bar is supported in contact with said nose bar mounting part at two vertically spaced positions when said at least one nose bar is fastened to said nose bar mounting part, said screw being inserted through and into said hole and threaded hole respectively at a position intermediate between said two positions, said screw being operable to cause said at least one nose bar to be deformed to reduce the volume of said space for displacement of said at least one nose bar relative to said nose bar mounting part by forcing against said at least one nose bar.

22. A rotary veneer lathe according to claim 17, wherein said at least one nose bar is divided at the portion thereof adjacent to the knife into at least two bar portions, each of the bar portions having at the lower end thereof said pressure edge for pressing against the log adjacent to the cutting edge of said knife.

23. A rotary veneer lathe according to claim 17, wherein said moving mechanism is provided for each of said nose bars of the rotary veneer lathe.

24. A rotary veneer lathe according to claim 17, wherein said rotary veneer lathe comprises a peripheral drive system including a drive shaft extending across said veneer lathe and a series of toothed drive wheels mounted on said drive shaft at a spaced interval, each of the toothed drive wheels having on the periphery thereof a number of pointed tooth-like projections which are engageable with the log periphery for driving the log.

25. A veneer cutting machine for cutting a veneer sheet from a wood block, comprising;

a knife support, a cutting knife fixedly mounted on said knife support and having at the tip end thereof a cutting edge, wherein a veneer sheet is cut by relative movement of one of said block and said knife support to the other of said block and said knife support with the cutting edge of said knife in engagement with said block, a plurality of nose bars juxtaposed along the cutting edge of said knife, mounted to a part of said knife support each of the nose bars having a pressure edge located adjacent to said cutting edge of said knife for pressing against the log adjacent to the cutting edge of said knife, said nose bar mounting part of the knife support being movable independently of said knife support, and adjusting means for independently adjustably moving said pressure edge of at least one of said nose bars toward and away from said cutting edge of the knife by causing said at least one nose bar to be deformed for displacement relative to said nose bar mounting part.

* * * * *